United States Patent [19]

Faller

[11] 4,241,863

[45] Dec. 30, 1980

[54] CONTAINER WITH MULTIPLE COMPARTMENTS

[75] Inventor: Rudolph A. Faller, Edina, Minn.

[73] Assignee: Champion International Corporation, Stamford, Conn.

[21] Appl. No.: 45,823

[22] Filed: Jun. 5, 1979

[51] Int. Cl.[3] ..... B65D 85/54; B65D 5/48

[52] U.S. Cl. ..... 229/27; 229/2.5 R

[58] Field of Search ..... 229/2.5, 29 M, 30, 27

[56] References Cited

U.S. PATENT DOCUMENTS

| | | | |
|---|---|---|---|
| 1,945,013 | 1/1934 | Wilson | 229/2.5 R |
| 2,091,126 | 8/1937 | Speer | 229/2.5 UX |
| 2,252,297 | 8/1941 | MacIntyre | 229/2.5 R X |
| 3,352,477 | 11/1967 | Eisenberg | 229/29 M X |
| 3,605,374 | 9/1971 | Mueller et al. | 229/2.5 UX |
| 3,786,982 | 1/1974 | Rakes et al. | 229/2.5 R |
| 3,863,832 | 2/1975 | Gordon et al. | 229/30 |
| 3,876,132 | 4/1975 | Kuchenbecker | 229/27 |
| 3,933,296 | 1/1976 | Ruskin et al. | 229/2.5 R |
| 3,968,922 | 7/1976 | Ruud | 229/31 R X |

*Primary Examiner*—Davis T. Moorhead

*Attorney, Agent, or Firm*—Evelyn M. Sommer

[57] ABSTRACT

A container formed from a single blank of paperboard material and having at least two compartments in the form of open-top trays hingedly coupled together and easily separable along the hinge. A film covers each tray to secure food therein. After folding along the hinge, the two trays are received in a cover sleeve. Each tray is formed from a plurality of planar walls, some of which have hingedly coupled flanges at the top thereof for receiving the covering film.

7 Claims, 8 Drawing Figures

CONTAINER WITH MULTIPLE COMPARTMENTS

BACKGROUND OF THE PRESENT INVENTION

The present invention relates to a container, especially for food, with separable multiple compartments, and more particularly, relates to a container in which food can be frozen, transported, heated and then served in which the multiple compartments making up the container can be selectively separated so that only a portion of the food so packaged can be utilized as desired.

With the widespread use of microwave heating, there has been a great demand for versatile, convenient and cheap packaging for food in which the food can be frozen, transported, stored and then heated and served. While there have been numerous prior art packages in this area, they have various disadvantages. For example, U.S. Pat. No. 4,013,798, issued to Goltsos, discloses a tray having a plurality of compartments, each of which receives a particular type of food and all of which are covered by a transparent sheet. However, these compartments are not separable from one another, so selective heating and serving of selected ones of the compartments is not readily possible; and these compartments are not foldable relative to one another, so the tray must remain in a flat configuration. Similarly, U.S. Pat. No. 3,933,296, issued to Ruskin et al., while disclosing a plurality of foldable compartments, fails to disclose the separable nature thereof. U.S. Pat. No. 3,511,433, issued to Andrews et al., discloses a container with two chambers, foldable relative to one another, but these chambers do not contain different types of food and are not separable.

SUMMARY OF THE INVENTION

Accordingly, it is an object of the present invention to provide a versatile and convenient container with separable multiple compartments so that different types of food in the compartments can be separately utilized in the heating and serving stage.

Another object is to provide a container with a plurality of foldable compartments and a cover to receive the folded compartments for easy stacking, packing and shipping.

Another object is to provide a container which is cheap to manufacture and which uses a simple cover film to keep separate various types of food contained in the various compartments.

The foregoing objects are obtained by providing a container comprising a first means defining a first compartment having an opening; a second means defining a second compartment having an opening; hinge means for hingedly coupling the first and second means together; first film means for covering the first compartment opening; and second film means for covering the second compartment opening.

This provides a container in which two different types of food can be selectively placed in the two compartments and protected therein by the covering film. Since the compartments are hingedly coupled, one can be folded on top of the other for easy stacking, packing and shipping. A cover sleeve can be utilized to keep the two compartments in their folded position.

Moreover, the hinge means is frangible so that the two compartments can be easily separated. This is accomplished by providing a perforated fold line between the material forming the two compartments. Thus, the two compartments are easily separated so that selective heating and serving of the different ingredients is easily accomplished.

BRIEF DESCRIPTION OF THE DRAWINGS

Other objects, advantages and salient features of the present invention will become apparent from the following detailed description, which, taken in conjunction with the annexed drawings, discloses preferred embodiments of the present invention.

Referring now to the drawings which form a part of this original disclosure.

DETAILED DESCRIPTION OF THE DRAWINGS

Figure 1:
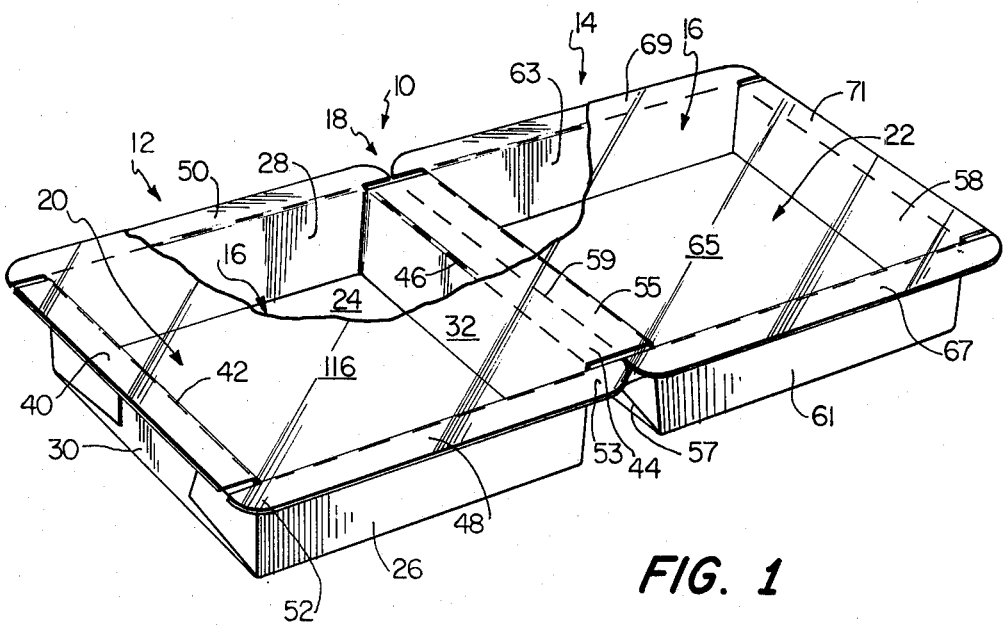
FIG. 1 is a right perspective view in elevation showing a container in accordance with the present invention having two trays provided therein.
Figure 2:
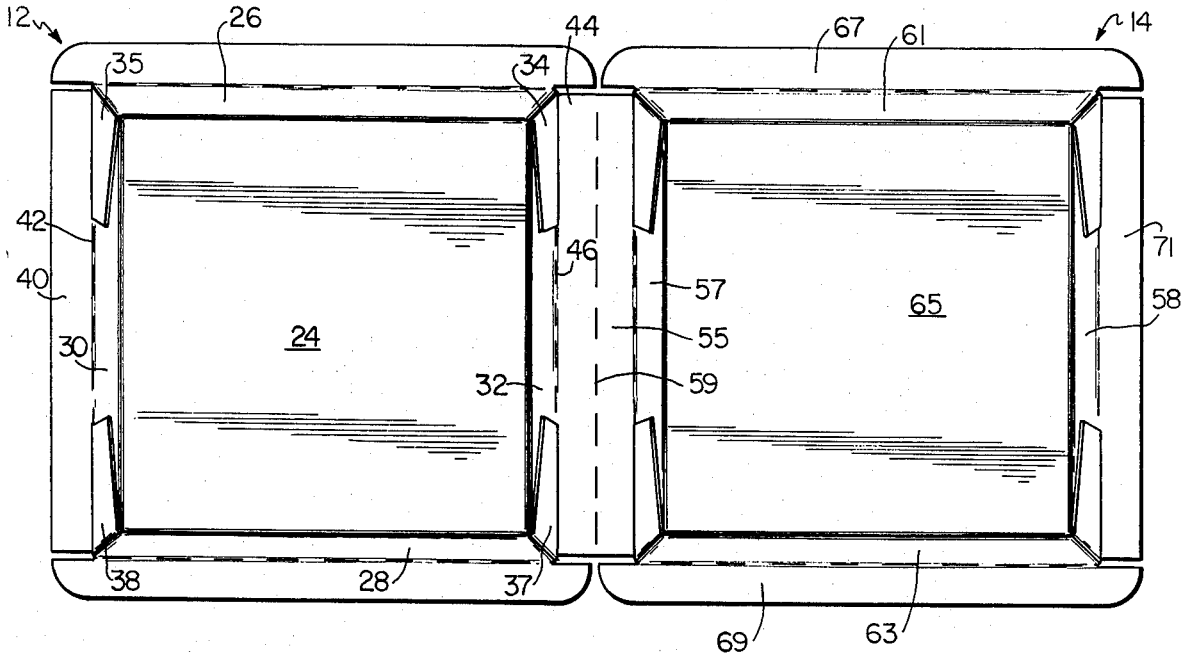
FIG. 2 is a bottom plan view of the container shown in FIG. 1.

Referring to the drawings in further detail, as seen in FIGS. 1 and 2, the container 10 comprises a first tray 12, a second tray 14, a cover film 16 and a hinge 18 hingedly coupling the two trays. The first tray 12 has an open top and defines a first compartment 20 for receipt of material, such as food. The second tray 14 is a mirror image of the first tray and has an open top and defines a second compartment 22 for the receipt of material, such as food, such food preferably being different from that received in the first compartment. Preferably, the first and second trays are comprised of a single piece of substantially rigid but foldable paper board. The walls forming each tray are planar and can be cut from the integral single piece of paper board.

The first tray 12 comprises a rectangular bottom wall 24, two opposed, trapezoidal side walls 26 and 28, and two opposed, trapezoidal end walls 30 and 32, however, a number of side walls in excess of four may be employed in practicing the invention.

The side walls and the end walls each extend upwardly from the bottom wall 24 and are integrally formed with the bottom wall, these walls being folded upwardly from the bottom wall. Although the side walls 26 and 28 and end walls 30 and 32 are disclosed herein as inclined with respect to the bottom wall, such side and end walls may extend perpendicular to the bottom wall and be essentially rectangular in shape. End flaps 34 and 35 extending from side wall 26 are folded over onto the outside of end walls 30 and 32 and are adhered thereto by a suitable adhesive. Similarly, end flaps 37 and 38 extending from the opposite ends of side wall 28 are folded over onto the outside of the opposite sides of end walls 30 and 32 and are adhered thereto by a suitable adhesive. This forms the basic tray configuration. It is noted that the paper board forming end flaps 34–35 and 37–38 and/or end walls 30 and 32 may be provided with a coating of suitable material which forms an adhesive when activated by heat, sonic or radio frequencies or other forms of radiant energy.

End wall 30 has at the top thereof integrally formed therewith a short top flange 40 which is folded outwardly along a creased or perforated fold line 42 between it and end wall 30. This top flange 40 extends the entire length of end wall 30.

Similarly, end wall 32 has extending outwardly from the top thereof a top flange 44 which is integrally formed with the end wall 32 and which is folded along a perforated fold line 46. The top flange 44 extends from one end to the other of end wall 32. Both of these perforated fold lines 42 and 46 provide a hinge type coupling between the flanges and the walls.

The side walls 26 and 28 each have an outwardly foldable, top flange 48 and 50, respectively, which is similar to the top flanges described above with regard to the end walls. However, each of the top flanges associated with the side walls has a pair of ears, for example, ears 52 and 53 on flange 48, which extend past the ends of the side wall 26. As seen in FIG. 1, ear 52 extends to a position substantially coextensive with the outer edge of rectangular top flange 40 on end wall 30, and ear 53 extends outwardly to a position coextensive with rectangular top flange 44, the details of which will be described hereinafter.

As seen in FIGS. 1 and 2, the second tray 14 is a mirror image of the first tray, having the same length, height and width and being formed of similar parts. Accordingly, this second tray will not be described in detail. However, it is to be noted the first and second trays 12 and 14 respectively may be of different heights, if desired, to accommodate variations in the depth of the food products to be contained therein.

The hinge 18 between the first and second trays is formed by a hinge coupling between top 44 on end wall 32 and a similar top flange 55 provided on end wall 57 of the second tray 14. This hinge connection is formed by having these two flanges 44 and 55 being integrally formed from the same piece of paper board and having a central perforated fold line 59 formed therein. This line is intermediate of the fold lines of the flanges 44 and 55 to their respective end walls 32 and 57. In this regard, it is noted that the ears extending from the flanges on the side walls of both trays near the hinge 18 all extend to a position substantially coextensive with central perforated fold line 59. In addition to end wall 57, the second tray is comprised of end wall 58, two side walls 61 and 63, and bottom wall 65. The side walls 61 and 63 have top flanges 67 and 69; and the end wall 58 has top flange 71.

As best seen in FIG. 1, the cover film 16 is a thin sheet of material, preferably of thermoplastic, which reacts to heat or electromagnetic radiation. One side of the paperboard container may be provided with a functional coating to which the film can be bonded with the application of heat, radiation or adhesive. This attachment includes the ears on some of the flanges which provides a substantially continuous surface for connection of the film to the trays. While this film 16 can be formed of one sheet as shown in FIG. 1, it can also be two separate sheets, one covering the first tray and the other covering the second tray.

In all events, once materials, such as food, are placed respectively inside the compartments formed in the first and second trays, the cover film 16 is placed thereover by coupling to the flanges. Then, the second tray 14 is folded along central perforated fold line 59 so that the portion of the film covering the second tray is in a face-to-face position with the portion of the film covering the first tray. This is shown specifically in FIG. 3.

The film 16 may be perforated along the hinge 18 and more particularly in registration with the fold line 59 to facilitate later separation of the trays 12 and 14. Perforation of the film 16 may be accomplished by the application of a suitable cutting edge or a heated wire thereto, either during or subsequent to the joining of the film 16 to the flanges.

Figure 3:
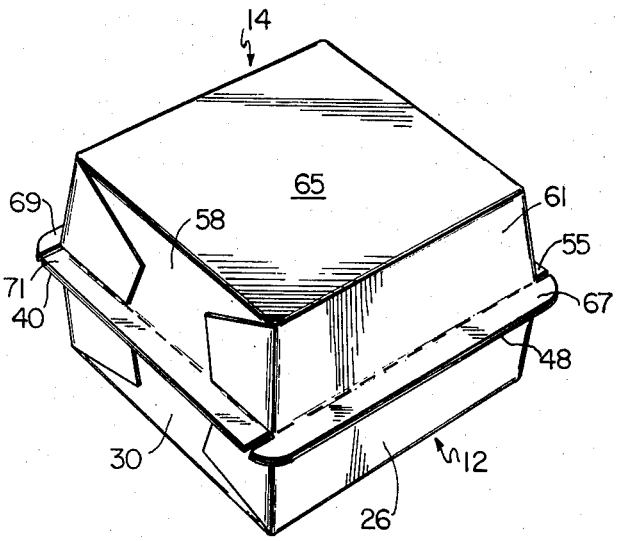
FIG. 3 is a right perspective view in elevation of the container shown in FIG. 1 in which the right hand tray has been folded along the hinge line connecting the two trays to a position in which the film covering each tray opening is in a face-to-face position.
Figure 4:
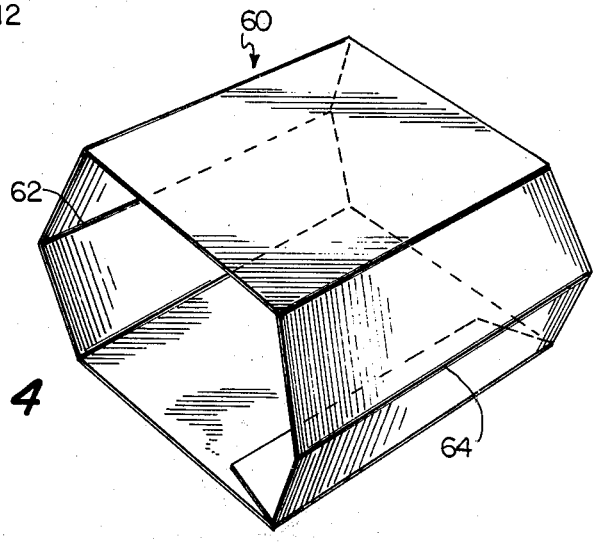
FIG. 4 is a right perspective view in elevation of a sleeve cover for use with the folded container shown in FIG. 3.
Figure 5:
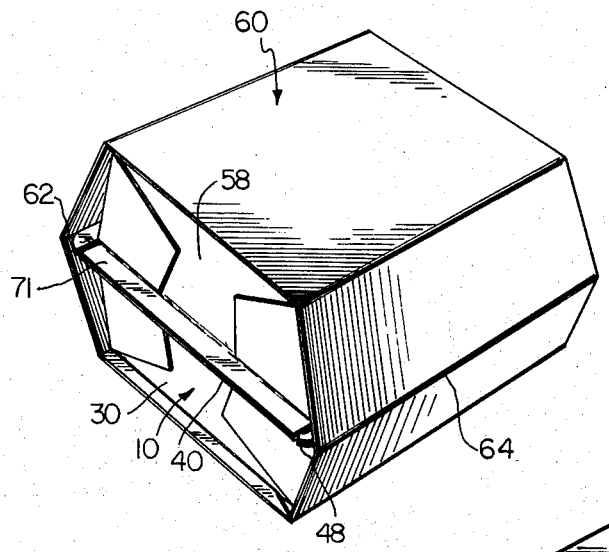
FIG. 5 is a right perspective view in elevation of the folded container shown in FIG. 3 received in the sleeve cover shown in FIG. 4.

As seen in FIG. 4, a cover, preferably formed of paper board, can be associated with the container and can receive the container in its folded position shown in FIG. 3. The container as received in the cover is shown in FIG. 5.

This cover 60 is preferably hexagonal in cross-section and is formed of a single, continuous piece of folded paper board which is formed into a sleeve by having the ends overlapped and glued together. The overall width of the cover 60 is preferably substantially equal to the overall width of one of the trays plus the flanges on the end walls. This is shown in FIG. 5 in which the container 10 has been received in the cover 60. It should be noted that the hexagonal shape of the cover provides substantial protection for the folded container, keeps the container in its folded position and also provides for very easy stacking of a plurality of these covered containers. As seen in FIG. 5, the hexagonal shape is particularly advantageous insofar as the four sets of top flanges on the side walls of the container 10 neatly align with opposing fold lines 62 and 64 in the hexagonal cover 60. Moreover, since the width of the cover 60 is substantially equal to the width of the tray plus the two end wall flanges, these flanges are suitably protected and essentially inside of the cover once the container is in its folded position.

By providing the central perforated fold line 59 between the two trays, the hinge 18 formed thereby is easily frangible to allow separation of the trays at will, thereby allowing selective use of the trays depending upon the desire of the user. For example, once a consumer purchases the container containing material such as food and freezes the food, only one of the ingredients in one of the trays need be defrosted, heated and served by merely separating the desired tray from the other one.

Moreover, by providing the first set of four flanges on the tops of the walls comprising the first tray and the second set of four flanges on the tops of the walls of the second tray, the cover film can be readily attached to the trays to secure the food therein. This also assures protection of the food during shipping and freezing. Of course, this cover film can easily be removed from the trays by severing the sheet material forming the cover film.

Figure 6:
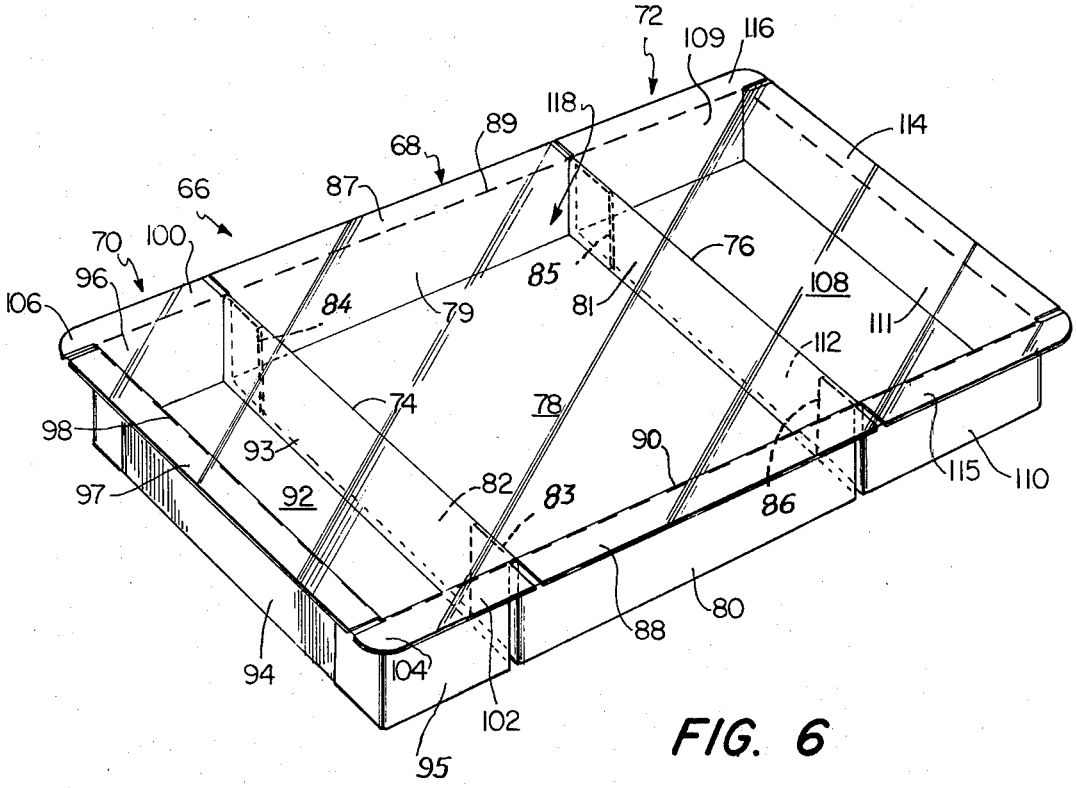
FIG. 6 is a modified embodiment of the present invention in which three trays are hingedly coupled together and are shown in the open position.
Figure 7:
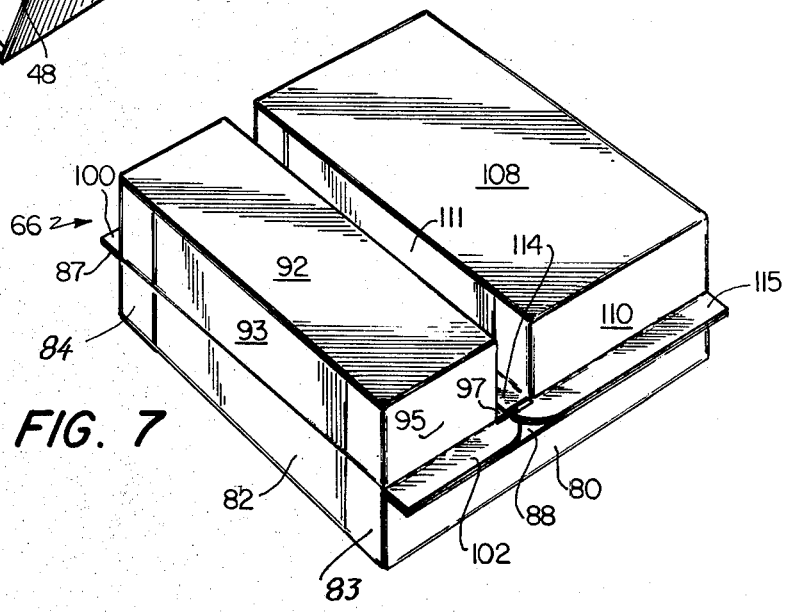
FIG. 7 is a right perspective view in elevation of the container shown in FIG. 6 in which the right hand tray has been folded over onto the central tray and the left hand tray has been folded over onto the central tray.
Figure 8:
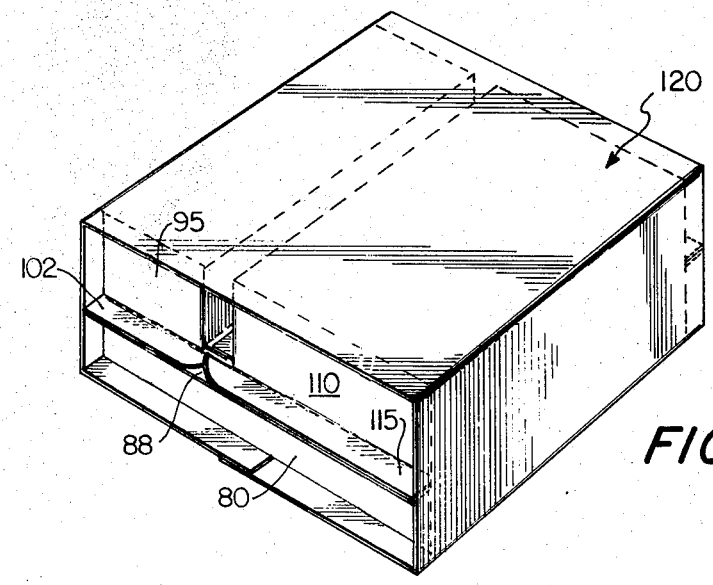
FIG. 8 is a right perspective view in elevation of the folded container shown in FIG. 7 received in a sleeve cover.

Referring now to FIGS. 6, 7 and 8, a modified embodiment of the present invention is shown in which rather than two compartments formed by two trays, the container has three trays and three compartments.

Referring to FIG. 6, the modified container 66 comprises a central tray 68, a left side tray 70 and a right side tray 72. All of these trays are formed from paper board preferably cut from a single blank. This results in a hinge connection via fold line 74 between the left side tray 70 and the central tray 68 and a hinge connection via fold line 76 between the right side tray 72 and the central tray 68. As seen in FIGS. 6 and 7, the width of central tray 68 is substantially equal to the sum of the widths of left side tray 70 and right side tray 72.

As seen in FIG. 6, the central tray 68 comprises planar, rectangular walls including a bottom wall 78, two opposed, side walls 79 and 80, and two opposed end walls 81 and 82. The bottom wall 78 is integrally formed with the side and end walls, each of these walls being folded upwardly to form the tray 68. Side walls 79 and 80 are respectively provided with sets of end flaps 84–85 and 83, 86 extending from the opposite ends thereof, which are folded inwardly into overlapping relationship to the corresponding end walls 81 and 82 and adhered to the latter by means of contact heat, heated air, radiation or conventional adhesives. Each of the side walls 79 and 80 has an integrally formed top flange 87 and 88 which is foldable along fold line 89 and 90, respectively.

The left side tray 70 is comprised of planar, rectangular walls including bottom wall 92, two opposed end walls 93 and 94 and two opposed side walls 95 and 96. The two opposed side walls have end flaps similar to the central tray 68 for forming the tray in the upright position. The end flaps 84, 85 and 83, 86 respectively oppose and abuttingly engage the end flaps associated with the trays 70 and 72 to maintain a spacing between the end walls 82 and 93 and between end walls 81 and 112. By this feature the container is rigidified and the flanges 87, 88, 100, 102, 115 and 116 are maintained essentially coplanar.

As seen in FIG. 6, the end wall 93 of the left side tray 70 and the end wall 82 of the central tray 68 are integrally formed and are hingable along fold line 74.

End wall 94 has extending upwardly therefrom a top flange 97 which is folded outwardly along fold line 98. Similarly, the two side walls 95 and 96 have, respectively, top flanges 100 and 102 similarly connected at the top thereof. Ears 104 and 106 are, respectively, provided on the outside ends of flanges 102 and 100 which extend outwardly to a position coextensive with the outer edge of flange 97. The other ends of top flanges 100 and 102 are coextensive with fold line 74.

The right side tray 72 is a mirror image of the left side tray 70, except that it is larger. Thus, the right side tray comprises a planar, rectangular bottom wall 108, two opposed side walls 109 and 110 and two opposed end walls 111 and 112. In a fashion similar to that described above regarding the left side tray, top flanges 114, 115 and 116 are provided respectively on end wall 111, side wall 110 and the other side wall 109.

It is noted, as seen in FIG. 6, that the end wall 112 of the right side tray 72 is hingedly connected to the central tray 68 by a fold line 76 between end wall 112 of the right side tray and end wall 81 of the central tray.

A cover film 118, similar to that described above regarding FIGS. 1–5, is provided on the embodiment shown in FIGS. 6–8 in which the film is adhered to the top flanges shown in FIG. 6.

As seen in FIG. 7, the left side tray 70 has been folded over onto the central tray 68 and the right side tray 72 has also been folded over onto the central tray. In this position, the cover film 118 associated with the central tray is in a face-to-face position with the cover film 118 associated with each of the left side and right side trays. Similarly, top flange 114 of the right side tray 72 and top flange 97 of the left side tray 70 overlap slightly and the ears shown in FIG. 6 on the top flanges 115 and 116 slightly overlap the ears on the top flanges 100 and 102.

In this position, a cover sleeve 120 shown in FIG. 8 can receive the container 66 to protect it, keep the various trays in their folded position and provide for easy stacking of the filled container.

As seen in FIG. 8, the cover sleeve 120 is preferably rectangular in cross-section and has a width substantially equal to the sum of the lengths of the bottom wall 78 in the central tray plus the two top flanges 87 and 88 associated therewith. This depth is also substantially equal to the extent of the bottom walls plus the side wall flanges in each of the left side and right side trays. Accordingly, the exposed flanges on the opposite sides of the container 66 are within the cover sleeve 120. This cover sleeve 120 is preferably formed of a continuous piece of paper board folded into the rectangular shape and having overlapping ends suitably adhered together.

While advantageous embodiments have been chosen to illustrate the invention, it will be understood by those skilled in the art that various changes and modifications can be made therein without departing from the scope of the invention as defined in the appended claims.

What is claimed is:

1. A container comprising:

(a) first and second symmetrical compartments formed from a single blank of paperboard material, and hingedly coupled together, (b) each of said compartments having a bottom wall, two end walls, each coupled to an opposite end of said bottom wall, and two side walls, each coupled to an opposite side of said bottom wall, (c) a set of four flanges on each compartment, each flange hingedly coupled to the top of one of said compartment walls, (d) a film covering each of said compartments, said film being attached to the four flanges thereon, (e) said first and second compartment coupling hinge connecting together a corresponding one of said flanges on each compartment whereby said compartments maybe folded about said hinge and superimposed over each other with said film in a face-to-face relationship, said folded compartments having a generally hexagonal cross-section, and (f) a sleeve cover for said container when said first and second compartments are folded about said hinge and superimposed over each other whereby said compartments are maintained in said superimposed relationship when placed within said sleeve.

2. A container as in claim 1 wherein said sleeve cover is formed with a hexagonal shape in transverse cross-section to correspond with the hexagonal cross-section of said folded compartments.

3. A container as in claim 2 wherein said covering film is formed from a sheet of material transparent to electromagnetic radiation in the microwave range of the spectrum.

4. A container as in claim 3 wherein said covering films are individually attached to said compartments.

5. A container as in claim 3 wherein said covering films are integrally connected together to form a unitary film.

6. A container comprising:

(a) first, second, and third compartments formed from a single blank of paperboard, each compartment having a bottom wall, two end walls, each coupled to an opposite end of said bottom wall and two side walls, each coupled to an opposite side of said bottom wall, (b) said second and third compartments each hingedly coupled along the upper end of one of said side walls to the upper edge portion of respective opposite side walls of said first compartment to position said second and third compartments on opposite sides of said first compartment, (c) said first compartment having a transverse width substantially equal to the sum of the transverse width of said second and third compartments, (d) a flange integrally formed with and hingedly attached to the top edge of the end walls of said second and third compartments and said side walls of said first, second, and third compartments, and (e) a film transparent to electromagnetic radiation in the microwave range of the spectrum covering said first, second, and third compartments and attached to said flanges on each compartment whereby said second and third compartments may be folded over said first compartment to form a cover therefor.

7. A container according to claim 6 and further including sleeve means for forming a cover for said three compartments when said second and third compartments are folded about said coupling hinges and superimposed over said first compartment.

* * * * *